US005354146A

United States Patent [19]

O'Konek

[11] Patent Number: 5,354,146

[45] Date of Patent: * Oct. 11, 1994

[54] PAVEMENT DIAMOND GRINDER

[75] Inventor: Dusten C. O'Konek, South Haven, Minn.

[73] Assignee: Diamond Surface, Inc., Maple Grove, Minn.

[ * ] Notice: The portion of the term of this patent subsequent to Nov. 10, 2009 has been disclaimed.

[21] Appl. No.: 909,648

[22] Filed: Jul. 7, 1992

Related U.S. Application Data

[63] Continuation-in-part of Ser. No. 546,417, Jun. 29, 1990, Pat. No. 5,161,910.

[51] Int. Cl.[5] ..... E01C 23/08

[52] U.S. Cl. ..... 404/90; 299/39; 464/182

[58] Field of Search ..... 404/93, 94, 90; 299/39; 464/182, 158, 185

[56] References Cited

U.S. PATENT DOCUMENTS 3,612,611 10/1971 Ellis ..... 299/39 X
3,788,704 1/1974 Staab ..... 299/39 X
3,874,806 4/1975 Grist et al. ..... 404/93
4,174,184 11/1979 Heenan ..... 404/94X
4,516,808 5/1985 Staab et al. ..... 299/39
4,623,277 11/1986 Wayne et al. ..... 464/182 X
4,900,094 2/1990 Sergeant ..... 404/94 X
5,083,839 1/1992 Younger ..... 299/39 X

*Primary Examiner*—William P. Neuder
*Attorney, Agent, or Firm*—Merchant, Gould, Smith, Edell, Welter & Schmidt

[57] ABSTRACT

A pavement grinder for grinding and grooving pavement surfaces has a grinding carriage with a rotating arbor supporting a number of radial blades. The arbor is directly coupled to shafts of hydraulic motors with an adapter between the arbor shaft and the motor shaft and includes an oil reservoir. Debris from grinding is removed by a removal system using suction. Suction bars extend behind and to the sides of the arbor and a shroud is positioned in front of the arbor. The debris is suctioned to a separation tank which directs the debris downward away from the vacuum force. Gravity and the downward momentum of the debris is greater than the vacuum force, so the debris is separated from the air flow. The debris is directed to the bottom of the tank and enters a slurry which is pumped for disposal.

16 Claims, 8 Drawing Sheets

PAVEMENT DIAMOND GRINDER

BACKGROUND OF THE INVENTION

This is a continuation-in-part of U.S. application Ser. No. 07/546,417, filed Jun. 29, 1990 now issued as U.S. Pat. No. 5,161,910.

1. Field of the Invention

The present invention relates to pavement diamond grinders and in particular to large scale pavement diamond grinders.

2. Description of the Prior Art

Pavement diamond grinders are used for grinding concrete and asphalt surfaces. Grinding is done to remove irregularities in the road surface, to provide texture to the surface to prevent skidding, and also to groove the surface to facilitate water drainage. Grinding, texturing and grooving are used on pavement surfaces including highways, airport runways and bridge decks, at industrial plants, and at stock pens and barns.

The diamond tipped blades which are used to grind the concrete or asphalt surface are mounted on a rotating arbor. The arbor is mounted on an undercarriage of the grinder so that end portions of the arbor are supported by bearings. According to the prior art, end portions of the arbor are mechanically driven by a system of belts and pulleys. The power supplied from the mechanical drive limits the torque supplied to the arbor. The width of the arbor cutting surface is then limited as greater power is required as more blades are added for a longer cutting surface. Because of power considerations, grinders have heretofore been limited to arbors having a three foot cutting width.

Directly coupling a motor to the arbor shaft presents wear problems in the drive linkage from the torque exerted. Continuous lubrication of the linkage which meets safety and environmental regulations provides for extended life for the drive linkage. Arbors have required continuous servicing for lubrication heretofore.

The width of the cutting path affects the time required to perform the grinding or grooving work. When grinding and grooving are performed, adjoining cuts must be precisely aligned to ensure proper cutting depth and an even pavement surface. The alignment process for each pass and added cutting passes due to narrower cutting heads greatly increase the time required for grinding.

The grinding and grooving processes create a substantial amount of debris in the form of concrete dust and particles. In addition, water is sprayed for dust control, cooling and lubricating. The resulting slurry must be removed from the pavement surface. Suction is used to continually remove the debris and water from the pavement so that the area where grinding occurs is kept clear.

The debris removed from grinding is very hard and abrasive, leading to severe wear problems on the debris removal equipment. The prior art removal systems use a cyclonic separator to separate the debris and water from the air flow. In a cyclonic separator, the debris is swirled around a circular upper portion of the separator and passed downward as it swirls along conical walls of the lower portion of the separator to an outlet at the bottom of the separator where it is pumped for disposal. The swirling action of the debris is especially abrasive, so that as the debris is swirled around the upper portion of the separator, the debris wears against the walls. The separator walls must then be replaced on a regular basis, adding a substantial expense and forcing equipment downtime.

In addition to having wear problems, the cyclonic separator chamber of prior art grinders accumulates debris when a clog in the disposal system occurs. The debris may back up further into the system and may damage the vacuum pump. The separator should provide a stop point to prevent debris from being drawn into the vacuum pump. When debris backs up, the separator must be cleaned before grinding may resume, causing substantial down time. It is therefore important that the chamber be easily cleaned should there be a backup in the debris removal system.

It can be seen then, that an improved pavement grinder is needed that provides a wider, directly driven cutting head. It can be appreciated that the debris removal system surrounding the arbor must be able to remove the debris created by grinding to keep the grinding area clear. It can also be seen that a separation tank is needed that limits the amount of wear and reduces the maintenance costs incurred due to wear and overcomes vacuum pump damage due to clogs in the system. The present invention solves these and other problems associated with pavement grinding.

SUMMARY OF THE INVENTION

According to the present invention, a pavement grinding apparatus has improved grinding and debris removal systems.

The improved pavement grinder has a grinding carriage having a hydraulically driven arbor rotating about an axle mounted transverse to the direction of travel. Diamond tipped blades are mounted along the shaft of the arbor so that the arbor grinds a wide swath on the surface of the pavement. The pavement grinder is powered by a main diesel engine supplying power for all systems of the grinder including the grinding, vacuum and drive systems.

The grinding system taps power from the main diesel engine to power a pair of hydraulic motors, one at each end of the arbor. The drive shaft of each motor is coupled directly to an end of the arbor. An adapter receives splines of the motor shaft at a first end of the adapter. The adapter has outer threads which mate with the inside threads of the end of the arbor shaft so that the motor shafts and the arbor shaft are axially aligned. The torque of the motors transfers directly to the arbor shaft with no loss of mechanical advantage. The adapter and shaft ends are threaded so that the adapter continuously tightens as the arbor rotates. The coupling is provided with an oil reservoir to lubricate the coupling.

As the arbor rotates, water is sprayed on the blades to cool and lubricate the arbor. The pavement debris is suspended in a slurry and vacuumed from the pavement surface through vacuum bars surrounding the arbor. The debris is drawn from the pavement surface into a vacuum tank where the debris falls to the bottom of the tank away from an upper duct leading to a vacuum pump. The pavement debris falls through a bottom outlet into a flow of water where it is further diluted and pumped to a holding tank or disposal site. The vacuum separation tank has inlets at the sides and vanes placed at the inlets to direct the incoming debris downward toward the tank outlet and away from the walls of the tank and away from the vacuum pump duct. The vanes and inlets are mounted on removable plates that are replaceable for easy repair and maintenance.

In operation, the vacuum pressure is maintained so that the debris is drawn into the separation tank. The debris is deflected downward from the inlet toward a bottom outlet. The vacuum pressure is set so that the vacuum is able to draw the debris into the tank, but is insufficient to overcome the momentum of the downward moving debris so that the debris is not drawn back to the vacuum pump so the pump is not damaged.

The debris is quite abrasive and wears away the vanes and the inlets. The vanes and inlets are mounted on removable plates so that the plates may be removed and replaced when worn, rather than replacing the walls, thereby cutting down on repairs and maintenance.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT(S)

Figure 1:
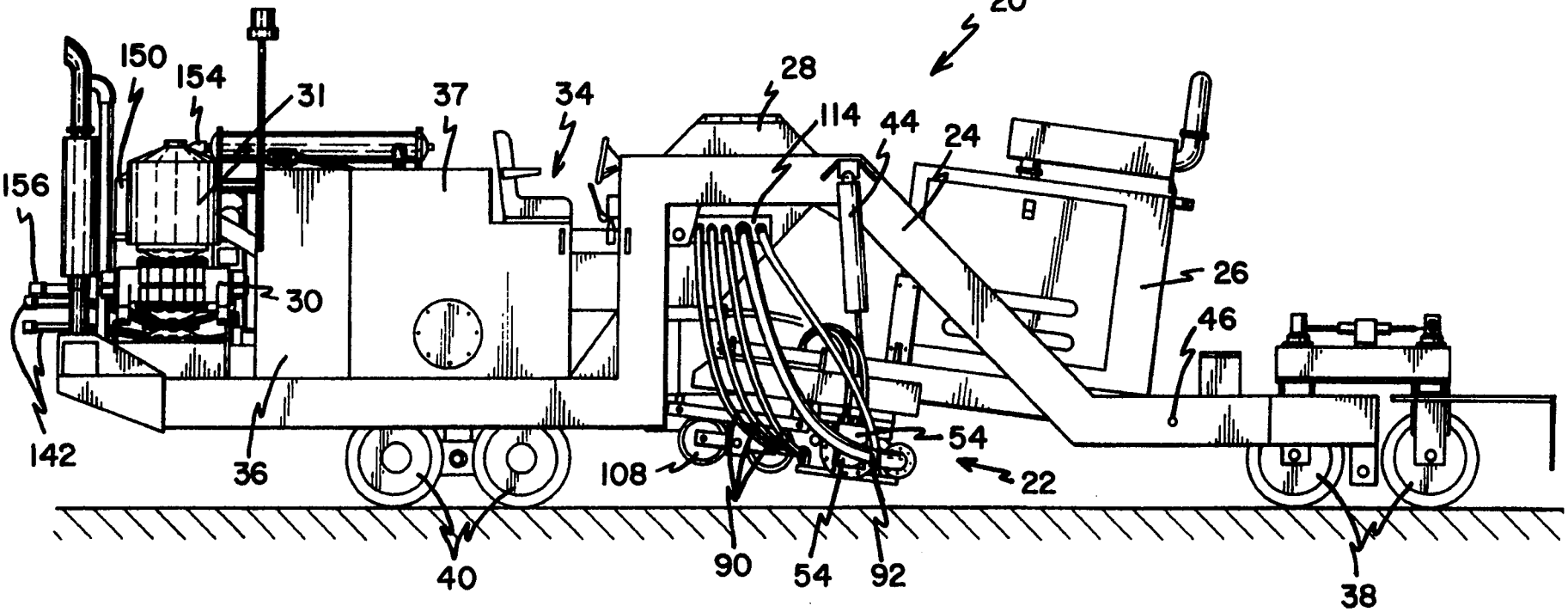
FIG. 1 is a side elevational view of a pavement grinder according to the principles of the present invention.

Referring now to the drawings, and referring in particular to FIG. 1, a pavement grinder, generally designated 20 is shown. The grinder 20 requires a large volume of water and pulls a water tank (not shown). The grinding and/or grooving occurs at the grinding carriage 22 which is supported by a frame 24. The grinder 20 is driven by a diesel engine 26, which also supplies power for other systems. Debris generated by grinding is suctioned up to a separation tank 28 with suction from a vacuum unit 30 having a blower 31.

While grinding, an operator walks beside the grinder 20 or sits at an elevated position at control station 34 above an oil tank 37 which is adjacent a fuel tank 36. The grinding must be constantly monitored by the operator so that proper cutting depth is maintained for an even finished surface and so that the cut is aligned with the previous cuts. The grinder 20 has forward drive wheels 38 and rear drive wheels 40 which propel the grinder 20 during grinding and provide a long wheelbase for smoother travel at the carriage 22.

Figure 2:
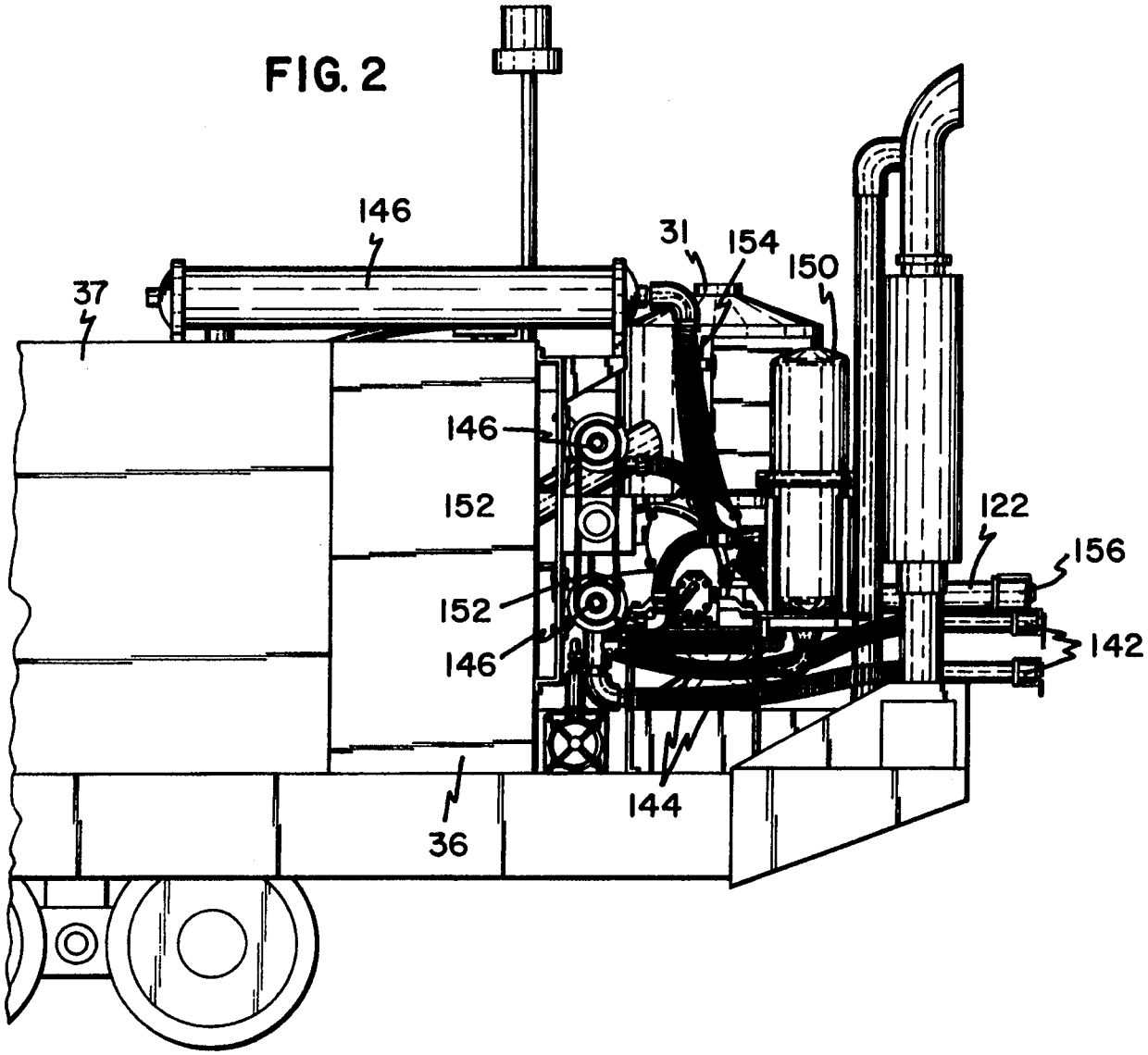
FIG. 2 is a left side elevational view of a rear portion of the pavement grinder shown in FIG. 1.

As shown in FIG. 2, water used for cooling, grinding lubrication, and debris removal, as explained hereinafter, is drawn through couplings 142 and water lines 144 to water pumps 146. The pumps 146 pump the water to filters 150 along lines 152. The filtered water then passes from the filters along lines 154 to oil cooler 140 and tank 37. The water cools the oil before being passed to other uses such as grinding lubrication or for a debris removal slurry, as explained hereinafter.

Debris from grinding is removed by a debris removal system. After the debris has been lifted from the ground and separated from the air stream in separation tank 28, as explained hereinafter, the debris enters a slurry. The slurry is pumped out the rear of the grinder 20 by trash pump 154 through slurry line 120 to outlet 156. The slurry is then stored in a tank for disposal or dumped adjacent the work site.

Grinding Carriage

Figure 3:
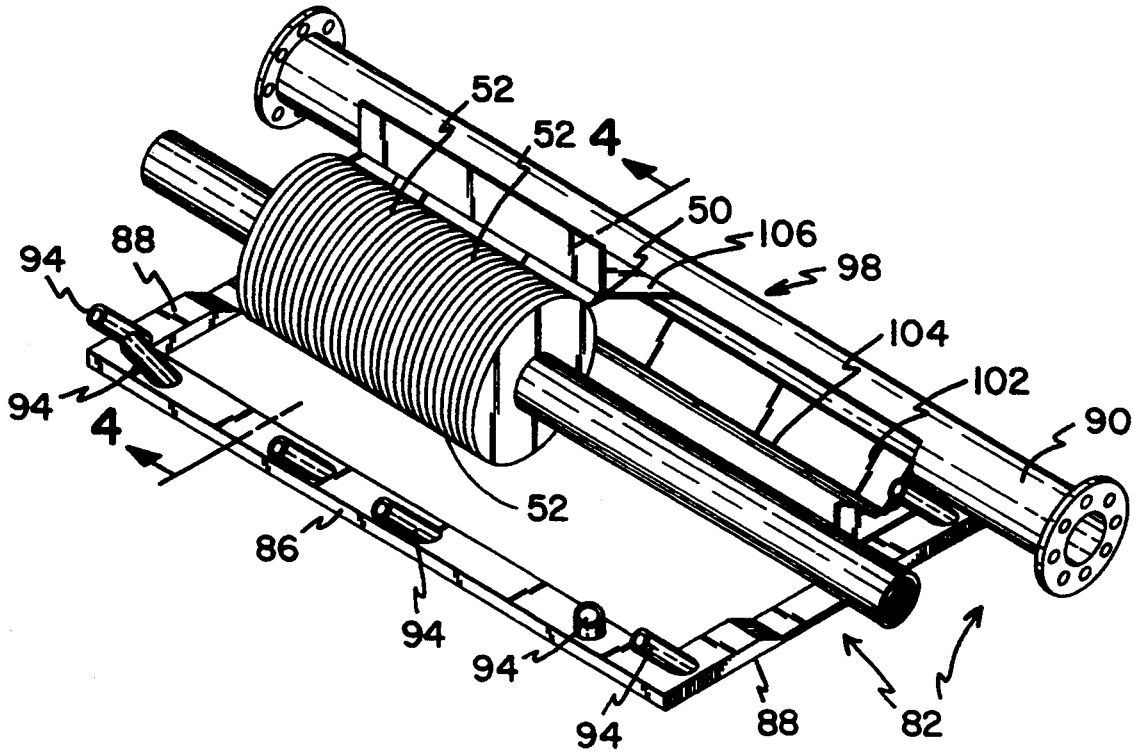
FIG. 3 is perspective view, partially broken away, of a grinding arbor and vacuum intake system of the pavement grinder shown in FIG. 1.
Figure 4:
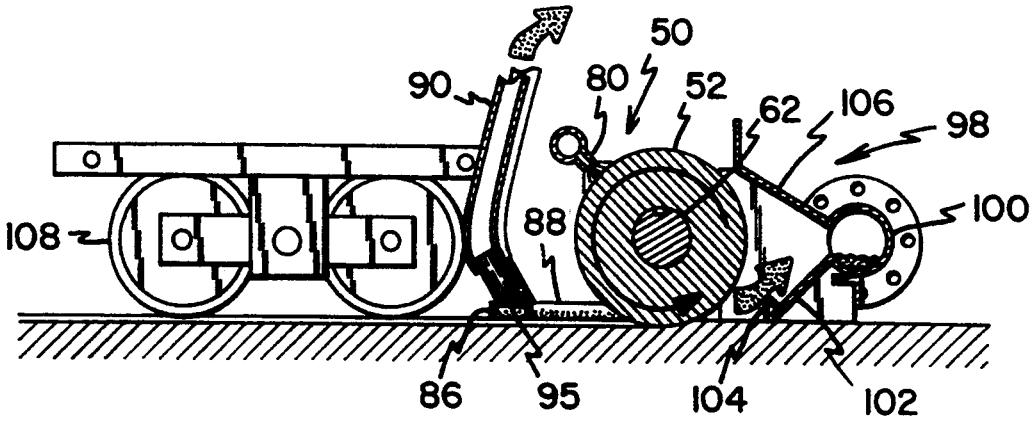
FIG. 4 is a sectional view taken along line 4—4 of FIG. 3.

As shown in FIG. 1, the grinding carriage 22 is raised or lowered by carriage lift mechanism 44 attaching to the frame 24. The carriage 22 lowers from a nonuse position, as shown in FIG. 1, to a desired cutting depth position for grooving and grinding, as shown in FIG. 4. The carriage 22 is also adjusted vertically to change the cutting depth by raising and lowering adjustment wheels 108 relative to the carriage. The carriage 22 pivots up and down about hinge 46 shown in FIG. 1. In addition, water spraying, arbor driving, and debris removal apparatus are supported by the carriage 22 and rise and descend with the carriage. The carriage 22 supports a cutting arbor 50 having an arbor shaft 62 with a multiplicity of radial blades 52 mounted side by side thereon, as shown in FIG. 3. In the preferred embodiment, the blades 52 define a cutting surface four feet wide.

Figure 5:
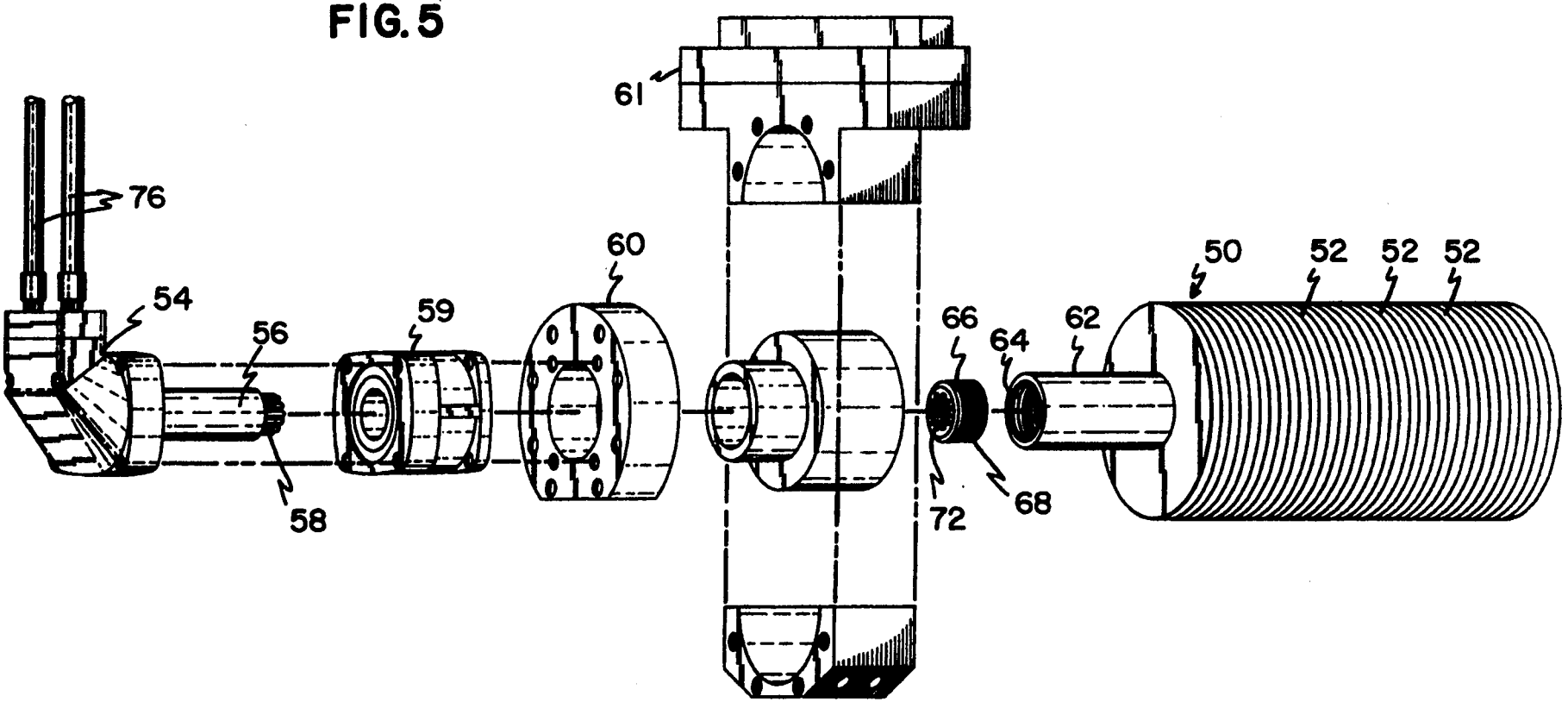
FIG. 5 is an exploded view of the end of the arbor shown in FIG. 3 and the connection to the arbor motor.

As shown in FIG. 5, the arbor 50 is driven directly at each end by an arbor motor 54 which has a motor casting 59 surrounding a motor shaft 56 which couples to a cylindrical adapter 66 attaching to the arbor shaft 62. The motors 54 attach to adaptive pillow blocks 60 and 61 supporting the arbor 50 on the carriage 22.

Figure 6:
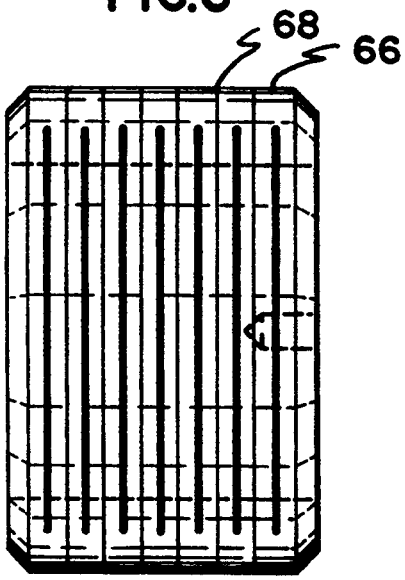
FIG. 6 is a side elevational view of an adapter for the connection between the arbor and the arbor motor shown in FIG. 5.
Figure 7:
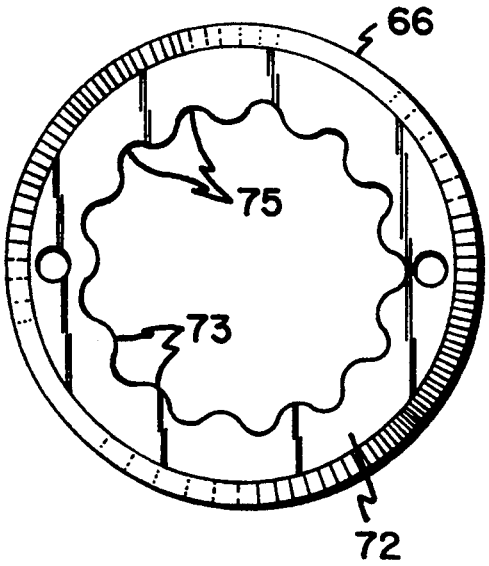
FIG. 7 is a front elevational view of the adapter shown in FIG. 6.

As shown in FIG. 6, the adapters 66 have a threaded exterior surface 68 which connects to a threaded interior surface 70 of the end portion 64 of the arbor shaft 62, shown in FIG. 5. The adapters 66 and end portions 64 are threaded so that as the arbor 50 rotates, the threads 68 and 70 are continuously tightening. A first end of the adapter 66 has a receiving portion 72, shown in FIG. 7. The receiving portion 72 accepts a motor shaft 56 which has splines 58 mating with the adapter receiving portion 72. The receiving portion 72 forms a ring around the motor shaft 56 and has projections 73 extending radially inward and alternating with recesses 75. The projections 73 insert between the splines and the recesses 75 receive the motor shaft splines 58. The number of recesses 75 and projections 73 match the number of splines 58, commonly 13 or 15. The splines 58 and projections 73 interlock in a ring configuration encompassing the motor shaft 56. The receiving portion 72 eases assembly as the splines 58 slide into the recesses 75 so that no further attachment or locking is required.

Referring again to FIG. 5, the motors 54 are hydraulically driven, receiving power from the engine 26 along hydraulic lines 76. The motors 54 are mounted on the adaptive pillow blocks 60 and 61 adapted for mounting at the sides of the carriage 22. The motors 54 raise and lower with the carriage 22 and directly drive the arbor 50, thereby eliminating the need for belts and pulleys. With the splines 58 mating with the adapter 66, the motor shafts 56 are coaxial with the arbor 50. It can be appreciated that by having the rotational axes of the motor shafts 56 aligned with the adapters 66 and arbor 50, the torque transfers directly from the motors 54 to the arbor 50 without power loss, thereby providing more cutting power to the arbor 50. Since the torque transfers directly, the additional grinding power provides for a wider cutting path and increased grinding speed.

During grinding, the blades 52 build up heat from the cutting friction and require cooling and lubrication. As shown in FIG. 4, water is sprayed from a plurality of nozzles 80 spaced along the arbor 50 onto the upper rear portion of the arbor blades 52 to cool and lubricate the blades 52 and to aid in controlling dust.

In operation, the carriage 22 is lowered to the ground. Water is sprayed on the blades 52 for lubrication and dust control and suctioned by the vacuum intake system, as explained hereinafter. The arbor 50 generally rotates so that the blades 52 "up cut" as shown by the arrow indicating rotation direction in FIG. 4. The height adjustment wheels 108 are raised or lowered so that the desired cutting depth is obtained while maintaining a constant downward pressure on the blades 52. The height is constantly monitored and must be aligned with preceding cuts.

Figure 12:
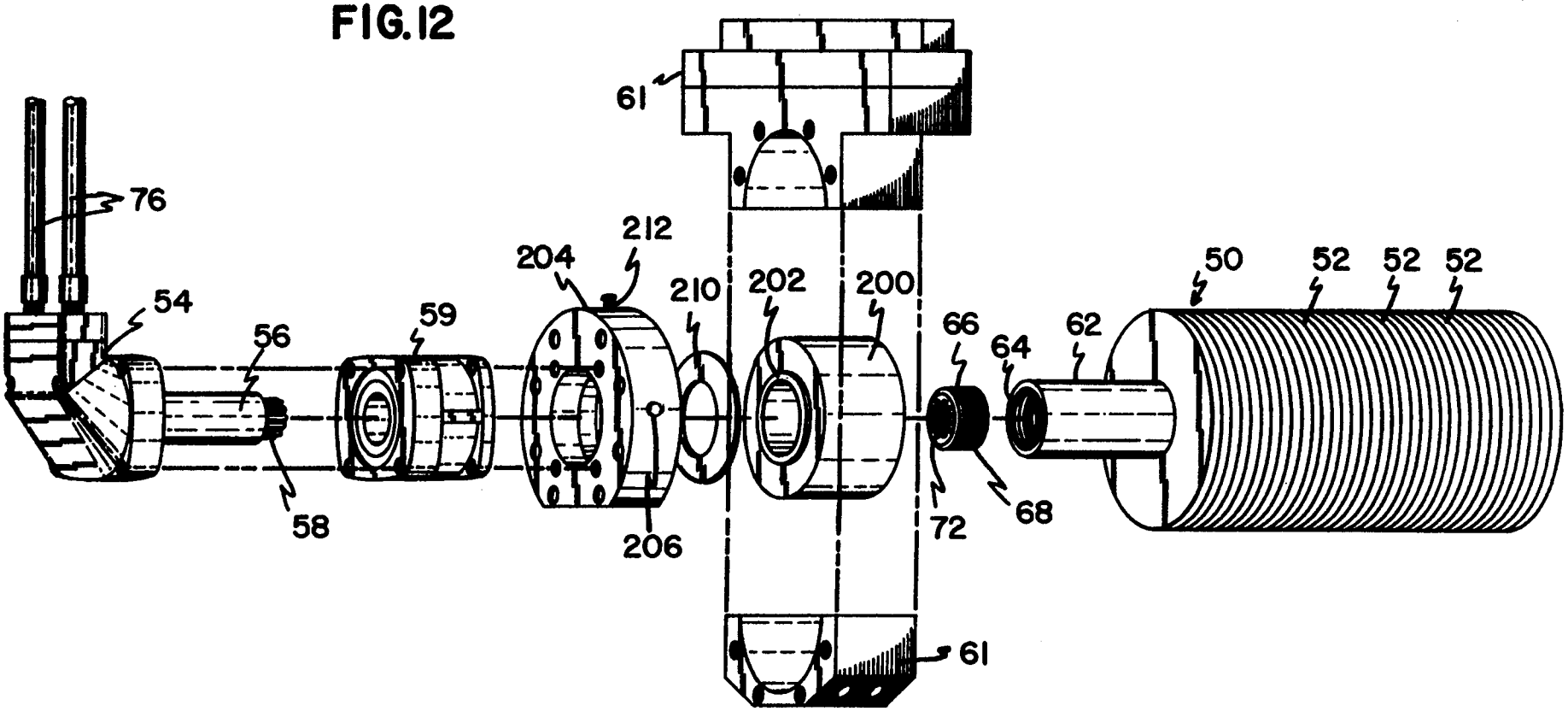
FIG. 12 is an exploded view of a second embodiment of the arbor and coupling to the arbor motor.
Figure 13:
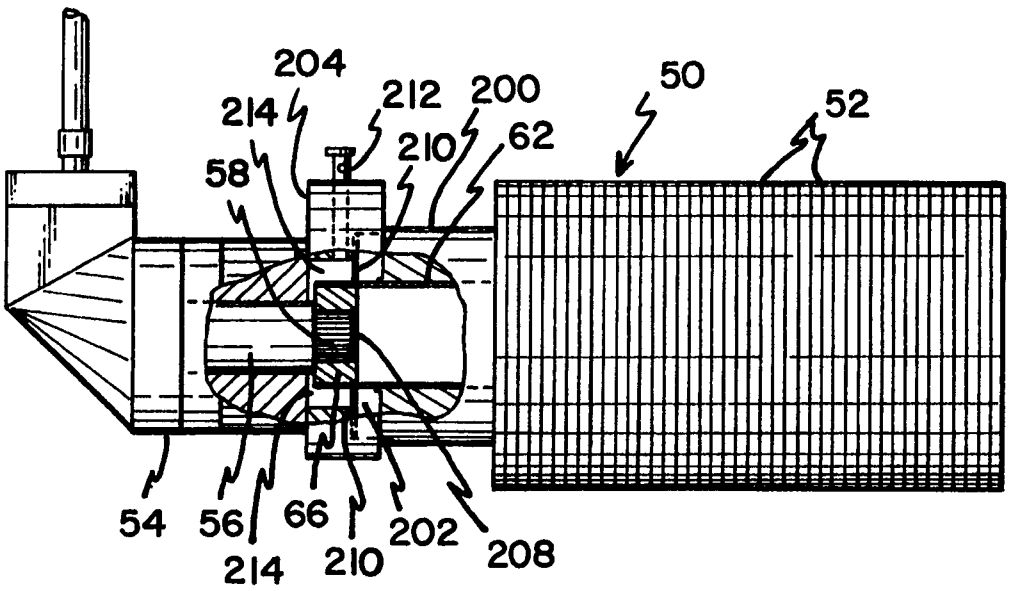
FIG. 13 is a side partial sectional view of the coupling to the arbor shown in FIG. 12.

Referring now to FIG. 12, there is shown a second embodiment of the coupling between the motor 54 and the arbor 50. According to the second embodiment, a motor adaptor 204 includes a seal plate 210 which forms a seal 208 in the cavity of the motor adaptor 204, as shown in FIG. 13, to store oil or lubricant for the coupling. The motor splines 58 insert into the adapter 66 which threadably couples to the arbor shaft 62. This coupling wears quickly if not lubricated. Lubrication is provided to the adapter 66 and splines 58 from oil or other lubricants, such as 140-weight oil, which can be stored in the 1½ pint cavity formed around the shaft 62. The reservoir is formed when the seal plate 210 is forced against the motor adaptor 204. The reservoir 214 is filled through a port 206 shown in FIG. 12. Should excessive heat build up, excess oil or other lubricant is allowed to expand out through a vent 212.

The fit of the connection between the splines 58 and the adapter 66 is the critical. Wear often requires replacement of the parts regularly and requires removal and lubrication every other day under normal operating conditions. The seal plate 210 is forced against the motor adapter by a sliding collar of the head bearing 200. The collar 202 is engaged by the arbor shaft 62 against the seal plate 210. This keeps the seal 208 tight so that no leakage will occur and maintenance for lubrication is avoided.

Debris Intake System

A vacuum intake system suctions the dust and debris from grinding and the water for lubrication for removal from the grinding area. Removing the debris reduces dust and wear to the equipment and improves grinding efficiency. As shown in FIGS. 3 and 4, vacuum intake system 82 includes a rear suction bar 86, side suction bars 88 and a forward intake shroud 98 surrounding the arbor 50. The intake shroud 98, the rear suction bar 86, and the side suction bars 88 are supported on the grinding carriage 22 and are raised and lowered with the carriage. The rear bar 86 attaches to the side suction bars 88 and drag on the ground around and behind the arbor 50 as the grinder 20 travels. The rear bar 86 and side bars 88 have a number of hose fittings 94 distributed across the top of the suction bars and hoses 90 leading from the fittings 94 to carry the debris away. The hose fittings 94 correspond to nozzles 95 located on the bottom of the near and side bars 86 and 88 suctioning debris from the ground. The shroud 98 along with the side suction bars 88 and the rear suction bar 86 remove the debris from the grinding area and prevent the debris from being scattered away from the grinding area and left on the pavement surface.

Since the arbor 50 generally rotates so that the leading edge is rotating upward, it is necessary to remove the debris that is thrown before the arbor 50, as well as the debris left in the path of the arbor 50. The shroud 98 prevents debris from being scattered forward and outward and directs the debris toward the vacuum suction. The intake shroud 98 stops debris kicked forward from the arbor 50 during grinding and directs the debris toward a duct 100 running parallel to the arbor. The intake shroud 98 includes a deflector plate 102 directing the debris forward and upward and an upper deflector plate 106 preventing the debris from being thrown up into the carriage 22. Together, the deflector plate 102 and upper deflector plate 106 funnel debris toward duct 100. The duct 100 then conveys the debris to hoses 92 at the ends of the duct, which deliver the debris to the separation tank 28 as shown in FIG. 1. The intake shroud 98 also has a flap 104 dragging on the ground which directs the debris onto the lower deflector plate 102 to reduce dust and prevent debris from scattering forward under the lower deflector plate.

Separation Tank

Figure 11:
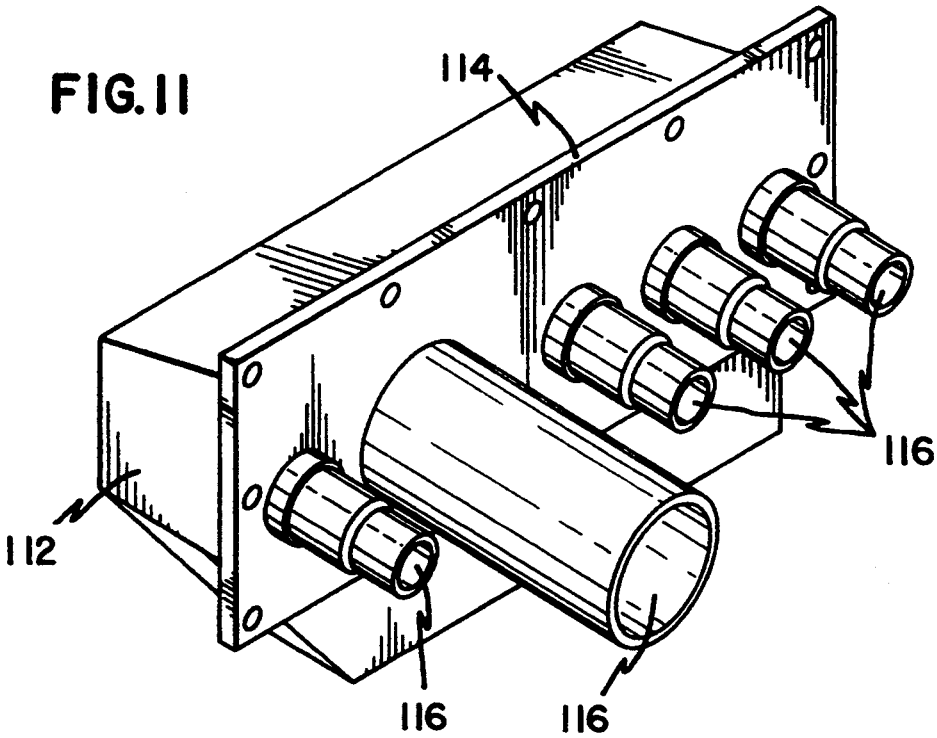
FIG. 11 is a perspective view of the removable intake for the separation chamber shown in FIG. 8.
Figure 8:
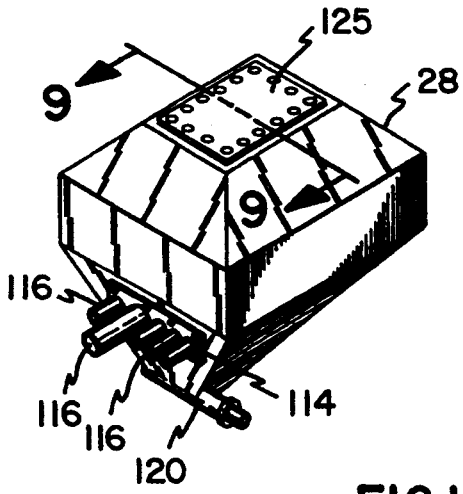
FIG. 8 is a perspective view of a separation chamber for the pavement grinder shown in FIG. 1.
Figure 9:
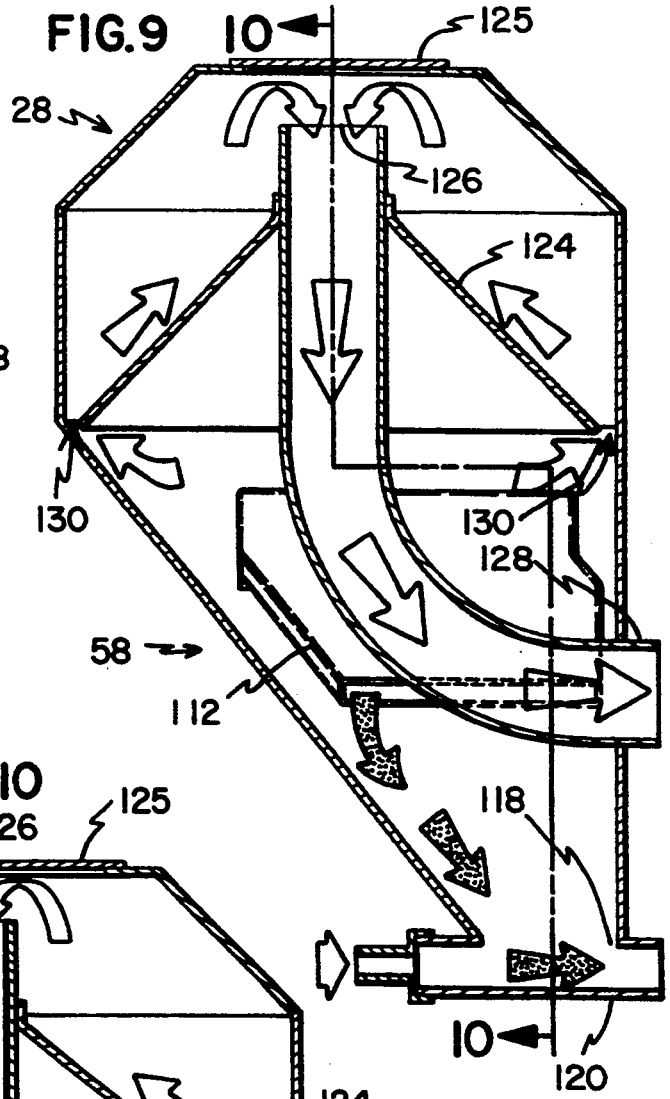
FIG. 9 is a sectional view of the separation chamber taken along line 9—9 of FIG. 8.
Figure 10:
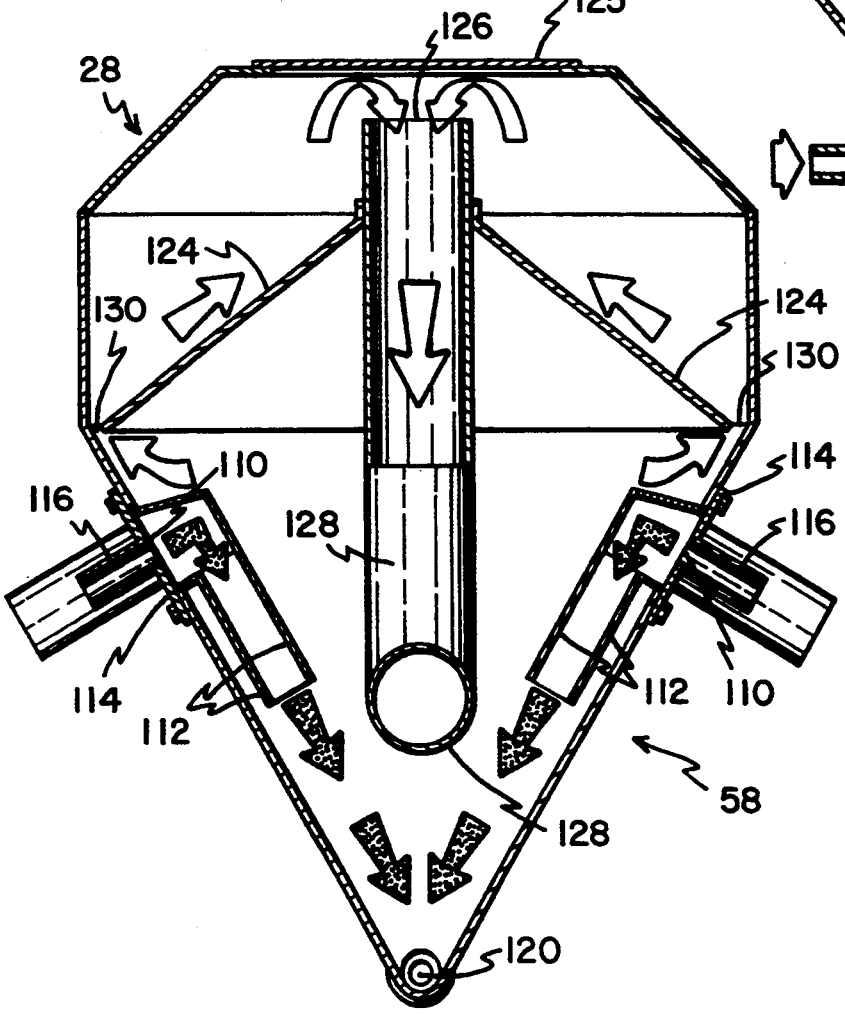
FIG. 10 is a sectional view of the separation chamber taken along line 10—10 of FIG. 9.

As shown in FIG. 1, the separation tank 28 receives debris suctioned by the intake system 82 through a plurality of hoses 90 and 92. As shown in FIGS. 8, 9 and 10, the front and sides of the lower portion 58 of the tank 28 taper to a narrow lowermost exit 118 to direct debris from the inlets to the exit. Inlets 110 are located along the sides of the tank 28 and are covered by plates 114 which, in the preferred embodiment are bolted to the tank 28 and are removable from the tank 28 as shown in FIG. 11. The plates 114 have hose fittings 116 mounted on an outer facing side and vanes 112 on the side facing into the separation tank 28. The fittings 116 receive the hoses 90 and 92 carrying debris from the vacuum intake system 82. The vanes 112 form a chute to direct the debris outward away from the sides of the separation tank 28 and downward toward the lower exit 118.

The separation tank 28 is accesses by removing cover 125 at the top of the tank. The upper portion of the separation tank 28 has a vacuum opening 126 of a vacuum pipe 128 shown in FIGS. 9 and 10. The vacuum pipe 128 passes through the separation tank 28, oil tank 37 and fuel tank 36 to a vacuum unit 30, shown in FIGS. 1 and 2. As shown in FIGS. 9 and 10, the upper portion of the separation tank 28 has a hood 124 sloping downward from the vacuum opening 126 and extending to the sides of the tank 28, with a narrow opening 130 around the hood 124 to increase airflow and provide for suction drawing upward from the lower portion 58 such that wear is at a minimum. The hood 124 also prevents debris from being suctioned into the opening 126 and damaging the vacuum unit.

In operation, the separation tank 28 has suction at the vacuum opening 126. This suction is sufficient to draw debris, indicated by shaded arrows in FIGS. 9 and 10, up through the intake system 82 and into the tank 28 through the inlets 110. The stream of debris enters the tank 28 through the inlets 110 and strikes the vanes 112. The vanes 112 form a chute spaced out from the plates 114 to direct the debris downward in a narrow stream away from the sides of the tank 28 toward the lowermost exit 118.

The suction force is maintained so that once the debris enters the tank 28 and is directed downward after striking the vanes 112, the suction force from vacuum opening 126 pulling upward in the tank 28 is not great enough to overcome the momentum of the downward moving stream of debris. The debris descends to the exit 118 and is carried away in the slurry along pipe 120, thereby separating from the airflow drawing to the vacuum unit 30. The slurry is pumped by trash pump 32 through outlet 156, shown in FIG. 2, to a disposal tank or disposal area at the site.

With the present invention, the debris is not caught in a cyclonic flow which wears away at the side walls as with the cyclonic separators of the prior art. The debris makes only a single pass over any area rather than the particles passing over the same area a number of times as with cyclonic flow. As shown in FIG. 10, with the present invention, a large portion of the wear occurs at the inlets 110 and the vanes 112 rather than the sides of the separation tank 28. Since these portions receiving the greatest wear are mounted on the plates 114, when wear occurs, the plates 114 may be removed and replaced with new plates. The replaceable plates 114 reduce wear to the sides of the separation tank 28, thereby prolonging the life of the separation tank 28. The inexpensive replaceable plates 114 also provide for quick maintenance of the separation chamber 28 and reduce repair costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A grinding apparatus, comprising:

a) a rotating arbor having an annular end portion including an interior surface having threads thereon;

b) a multiplicity of radial blades mounted along said arbor;

c) a motor at each end of said arbor, each of said motors having a splined motor shaft;

d) adapters directly connecting said ends of said arbor to said splines of said motor shafts, wherein said adapters have an exterior threaded surface threading to the threads of the annular end portion of the arbor and an end portion having radially inward extending projections inserting between the splines for engaging the motor shaft; and e) a vacuum intake shroud extending along the arbor including a deflecting plate and lower flap extending to the ground for deflecting debris up and away from the arbor to a vacuum source.

2. An apparatus according to claim 1, wherein the width of said multiplicity of blades on said arbor is at least four feet.

3. An apparatus according to claim 1, wherein a first threaded portion at a first end of said arbor has clockwise threads and a second threaded portion at a second end of said arbor has counterclockwise threads, such that as said arbor rotates, said adapters tighten on said threaded portions.

4. A grinding apparatus, comprising:

a) a rotating arbor having an annular end portion including an interior surface having threads thereon;

b) a multiplicity of radial blades mounted along said arbor;

c) a motor at each end of said arbor, each of said motors having a splined motor shaft;

d) adapters directly connecting said ends of said arbor to said splines of said motor shafts, wherein said adapters have an exterior threaded surface threading to the threads of the annular end portion of the arbor and an end portion having radially inward extending projections inserting between the splines for engaging the motor shaft; and e) oil storage means for storing oil to lubricate the splines and adapters.

5. An apparatus according to claim 1, wherein the motors are hydraulically driven motors.

6. An apparatus according to claim 1, further comprising an oil reservoir storing oil to lubricate the splines and adapters.

7. An apparatus according to claim 4, wherein the motor mounts to a motor adaptor, the motor adaptor including a seal plate to form a seal with the motor adaptor, the seal closing off a cavity formed by the seal and motor adaptor, and wherein the cavity if filled with lubricant for lubricating the coupling between the motor and the arbor.

8. A pavement grinding apparatus for grinding pavement surfaces, comprising:

a rotatable arbor having a shaft with a multiplicity of blades mounted thereon, a hydraulic motor at each end of the arbor shaft;

means for directly coupling the hydraulic motors to the arbor shaft, wherein the motors directly drive the arbor; and lubricant storage means for storing a coupling lubricant.

9. A pavement grinding apparatus according to claim 8, wherein the hydraulic motors axially align with a rotational axis of the arbor.

10. A pavement grinding apparatus according to claim 8, wherein the motor attaching means comprises an adapter at each end of the arbor attaching to the arbor shaft and to a shaft of the motor.

11. A pavement grinding apparatus according to claim 10, wherein the arbor shaft includes interior threaded end portions and wherein the adapter includes exterior threads configured for fitting against the threaded end portions.

12. A pavement grinding apparatus according to claim 10, wherein the motor include splines extending from the shaft, and wherein the adapter includes an annular end portion and a plurality of projections extending radially inwardly within the annular end portion configured to extend intermediate the splines of the motor shaft.

13. A pavement grinding apparatus according to claim 10, wherein the projections comprise curving surfaces curving radially inward between the splines and radially outward around the splines.

14. A pavement grinding apparatus according to claim 8, further comprising a lubricant fill port to the lubricant storage means.

15. A pavement grinding apparatus according to claim 14, further comprising a vent for releasing excess lubricant from the lubricant storage means.

16. A pavement grinding apparatus according to claim 8, wherein the motor mounts to a motor adaptor, the motor adaptor including a seal plate to form a seal with the motor adaptor, the seal closing off a cavity formed by the seal and motor adaptor, and wherein the cavity if filled with lubricant for lubricating the coupling between the motor and the arbor.

* * * * *